US012318673B2

(12) United States Patent
Curtis

(10) Patent No.: US 12,318,673 B2
(45) Date of Patent: Jun. 3, 2025

(54) TARGET BOARD FOR BEAN BAG TOSS GAME

(71) Applicant: ZHOOPL, LLC, Powhatan, VA (US)

(72) Inventor: Robert D. Curtis, Powhatan, VA (US)

(73) Assignee: ZHOOPL, LLC, Powhatan, VA (US)

( * ) Notice: Subject to any disclaimer, the term of this patent is extended or adjusted under 35 U.S.C. 154(b) by 0 days.

(21) Appl. No.: 17/544,409

(22) Filed: Dec. 7, 2021

(65) Prior Publication Data

US 2023/0173360 A1 Jun. 8, 2023

(51) Int. Cl.
*A63B 63/08* (2006.01)
*A63B 67/06* (2006.01)

(52) U.S. Cl.
CPC ..... *A63B 63/08* (2013.01); *A63B 67/06* (2013.01)

(58) Field of Classification Search
CPC ..... A63B 63/08; A63B 67/06
USPC ..... D21/303
See application file for complete search history.

(56) References Cited

U.S. PATENT DOCUMENTS 406,342 A * 7/1889 Dumont ..... A63B 67/06 273/402
4,923,201 A * 5/1990 Nichol ..... A63F 9/02 273/127 R
4,943,065 A * 7/1990 DeLapa ..... A63B 67/06 D21/303
5,007,644 A * 4/1991 Bluthardt ..... A63B 67/02 473/157
6,244,598 B1 * 6/2001 Conville ..... A63B 67/06 273/402
7,775,525 B2 * 8/2010 Staver ..... A63B 67/06 273/317.1
D726,830 S * 4/2015 Olden ..... D21/303
2007/0132186 A1 * 6/2007 Koralia ..... A63B 67/06 273/400
2013/0026713 A1 * 1/2013 Angel ..... A63B 63/08 273/398
2016/0038809 A1 * 2/2016 Rockwell ..... A63F 7/0612 273/401
2019/0009156 A1 * 1/2019 Skala ..... A63B 67/06
2021/0260456 A1 * 8/2021 Lombardini ..... A63B 71/023

OTHER PUBLICATIONS

"Cornhole" internet article, available at https://en.wikipedia.org/wiki/Cornhole, last accessed Dec. 7, 2021.

* cited by examiner

*Primary Examiner* — Jeffrey S Vanderveen
(74) *Attorney, Agent, or Firm* — PATENT PORTFOLIO BUILDERS PLLC

(57) ABSTRACT

A bean bag toss game target device comprises a support frame adapted to sit on a surface, a first planar game surface supported by the support frame at a first angle to the surface and at a first height above the surface, and a second planar game surface supported by the support frame at a second angle to the surface and at a second height above the surface. The first planar game surface defines a first target hole, and the second planar game surface defines a second target hole. The first planar game surface is closer to the proximal end of the target device than is the second planar game surface, and the second planar game surface is closer to the distal end of the target device than is the first planar game surface. The first height above the surface is less than the second height above the surface.

19 Claims, 2 Drawing Sheets

TARGET BOARD FOR BEAN BAG TOSS GAME

CROSS-REFERENCE TO RELATED APPLICATIONS

This application is related to pending U.S. Design application Ser. No. 29/818,115, filed Dec. 7, 2021, the contents of which are incorporated herein by reference in its entirety.

FIELD OF THE INVENTION

The present technology relates bean bag toss games.

BACKGROUND OF THE DISCLOSURE

Corn hole is a popular bean bag toss game involving throwing a bean bag from a predetermined distance at a planar target board, with the goal of getting the bean bag through a target hole defined in the target board. The target board typically has two front legs and two longer back legs, such that the target board is angled relative to the surface upon which it sits.

Since corn hole has been around so long, many players have mastered the conventional game and are looking for new bean bag toss games that are more challenging to play.

BRIEF SUMMARY OF THE DISCLOSURE

In one embodiment of the invention, a bean bag toss game target device comprises a support frame adapted to sit on a surface, a first planar game surface adapted to be supported by the support frame at a first angle to the surface and at a first height above the surface, and a second planar game surface adapted to be supported by the support frame at a second angle to the surface and at a second height above the surface. The first planar game surface defines a first target hole, and the second planar game surface defines a second target hole. The first planar game surface is closer to the proximal end of the target device than is the second planar game surface, and the second planar game surface is closer to the distal end of the target device than is the first planar game surface. The first height above the surface is less than the second height above the surface.

The first angle and the second angle may be substantially equal.

The target device may further comprise a substantially vertical planar backboard at the distal end of the target device. The backboard may have a proximal side toward the proximal end of the target device and an opposing distal side. The target device may further comprise a target hoop affixed to the backboard and projecting outward from the proximal side of the backboard. The target device may further comprise a net affixed to and hanging down from the target hoop. The backboard may define a third target hole.

The target device may further comprise a substantially horizontal shelf adapted to be supported by the support frame at a third height above the surface. The shelf may be affixed to or integral with and projecting outward from the proximal side of the backboard. The third height may be less than the second height.

The support frame, the first planar game surface, the second planar game surface, the backboard, and the shelf may be all together formed from a single unitary sheet of material.

A distal end of the first planar game surface may be connected to a proximal end of the second planar game surface. The distal end of the first planar game surface may be connected to the proximal end of the second planar game surface via a substantially vertical wall.

The first planar game surface, the second planar game surface, and the substantially vertical wall may be all together formed from a single unitary sheet of material.

The support frame, the first planar game surface, the substantially vertical wall, the second planar game surface, the backboard, and the shelf may be all together formed from a single unitary sheet of material.

The first target hole may be a sole hole defined by the first planar game surface.

The second target hole may be a sole hole defined by the second planar game surface.

Alternative embodiments of the invention comprise methods for playing a bean bag toss game using a target board as described herein.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
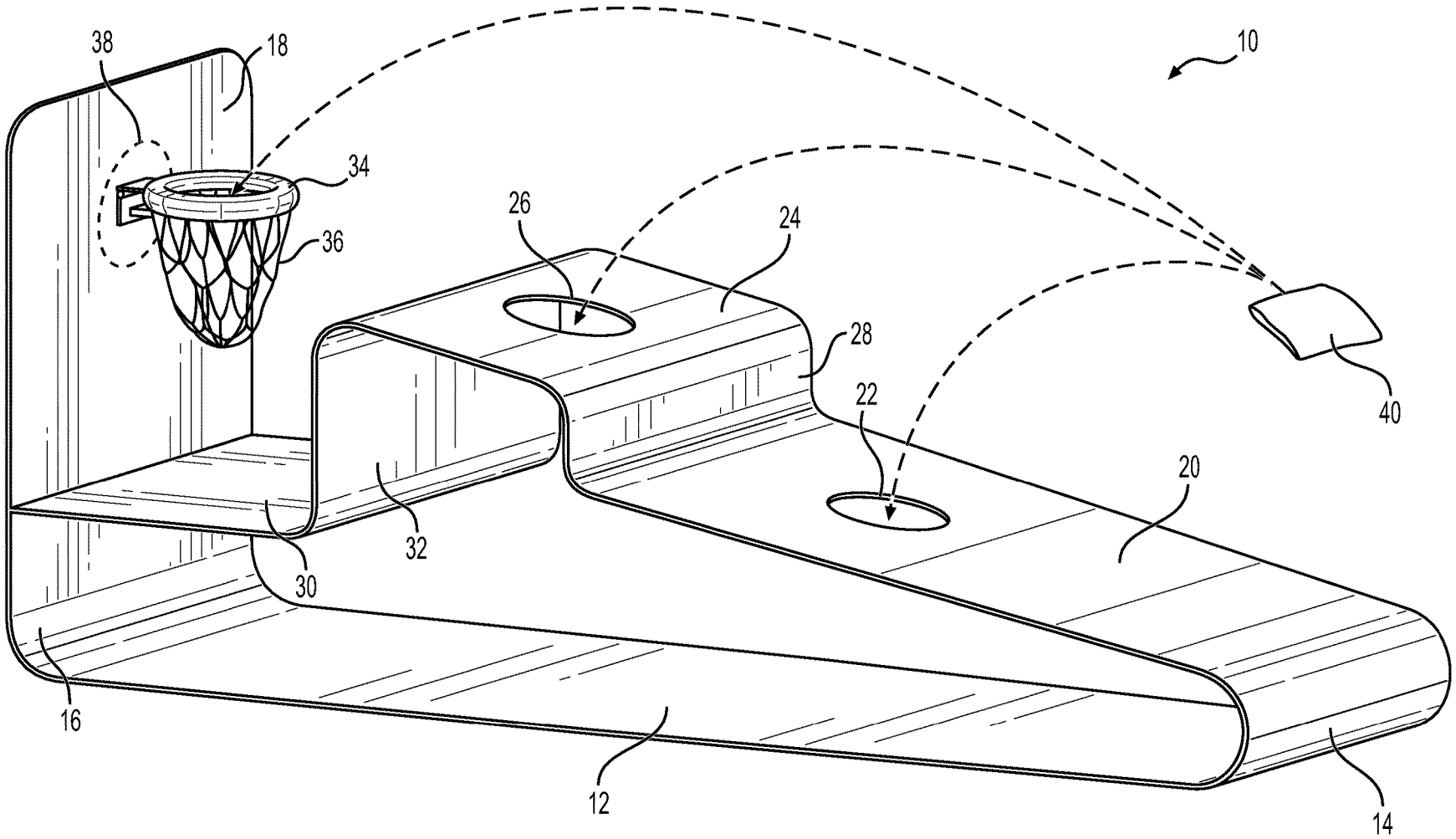
FIG. 1 is a perspective view of a target for a bean bag toss game, in accordance with embodiments of the present invention.

Certain terminology is used in the following description for convenience only and is not limiting. The words "lower," "bottom," "upper," "top," and the like designate directions in the drawings to which reference is made. The words "inwardly," "outwardly," "upwardly," "downwardly," and the like refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Figure 2:
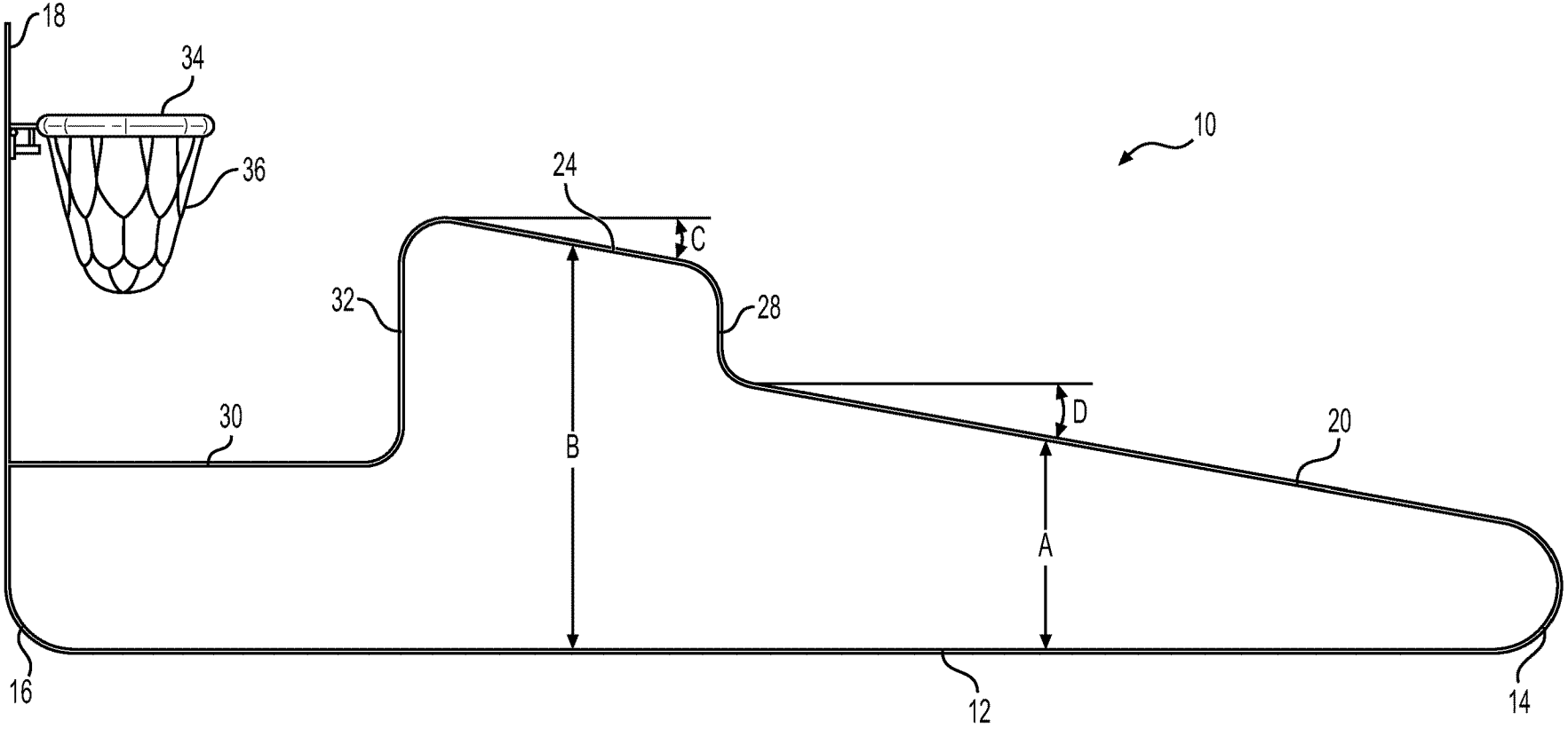
FIG. 2 is a side view of the target of FIG. 1.

Embodiments of the invention comprise a beanbag toss game target board or device with two or more different game surfaces, each game surface having at least one target hole, to provide a more challenging bean bag toss game. Referring now to FIGS. 1 and 2, a bean bag toss game target device 10 comprises a bottom surface or foot 12. The foot 12 is generally planar and enables the target device 10 to sit stably on a surface, such as a parking lot, a street, a gymnasium floor, or the ground. (Alternatively, the foot could be non-planar and have a more complex contour for aesthetic and/or other reasons.) The proximal end 14 of the target device 10 curves upward to support the upper structure (described below), although the proximal end could alternatively be planar with an angular connection to the foot (or could have any other suitable structure and contour) (however, the curved proximal end has a desirable aesthetic). The distal end 16 of the target device 10 also curves upward to support the upper structure (described below), although the distal end could alternatively be planar with an angular connection to the foot (or could have any other suitable structure and contour) (however, the curved distal end has a desirable aesthetic). During play, the proximal end 14 is positioned toward the player tossing a bean bag 40 at the target device 10. Game play typically involves two identical target devices positioned with their proximal ends toward each other and spaced at a suitable distance (the distance may be set by rule or may vary based on the age and/or experience of the players). Together, the foot 12, the proximal end 14, and the distal end 16 comprise a support frame that supports the game surfaces and other upper structures (described below). In alternative embodiments of the invention, conventional legs (or any other suitable support mechanism) could be used in place of the illustrated support frame.

The target device 10 comprises two game surfaces at two different heights to increase the interest and difficulty of the bean bag toss game. The target device 10 comprises a first planar game surface 20 defining a first target hole 22. (There may be only one target hole defined in the first planar game surface, as illustrated, or (less preferably) more than one target hole.) The first planar game surface 20 is at a first height (indicated by arrow A in FIG. 2) above the foot 12 (and therefore above the surface upon which the target device sits). The first planar game surface 20 is a first angle (indicated by curved arrow D in FIG. 2) to the foot 12 (and therefore to the surface upon which the target device sits). Since the first planar game surface 20 is angled upward from its proximal end to its distal end, the height of the first planar game surface 20 above the foot 12 and surface varies along its length. When considering the height of the first planar game surface 20, it may be the height of its proximal end, the height of its distal end, the height at the midpoint of the target circle, or any other suitable measurement point.

Unlike conventional corn hole target boards, the target device 10 comprises a second planar game surface 24 defining a second target hole 26. (There may be only one target hole defined in the second planar game surface, as illustrated, or (less preferably) more than one target hole.) The second planar game surface 24 is at a second height (indicated by arrow B in FIG. 2) above the foot 12 (and therefore above the surface upon which the target device sits). The second planar game surface 24 is a second angle (indicated by curved arrow C in FIG. 2) to the foot 12 (and therefore to the surface upon which the target device sits). Since the second planar game surface 24 is angled upward from its proximal end to its distal end, the height of the second planar game surface 24 above the foot 12 and surface varies along its length. When considering the height of the second planar game surface 24, it may be the height of its proximal end, the height of its distal end, the height at the midpoint of the target circle, or any other suitable measurement point. In the illustrated embodiment, the first planar game surface 20 is at a lower height than the second planar game surface 24. (It would be possible to have the first planar game surface is at a greater height than the second planar game surface, but that would likely not be desirable.)

In the illustrated embodiment, the distal end of the first planar game surface 20 is connected to the proximal end of the second planar game surface 24 via a substantially vertical wall 28. (It is not necessary that the wall 28 be perfectly vertical, and minor variances (e.g., less than about 10 degrees from vertical) are typically acceptable. In alternative embodiments of the invention, it may be desirable to have the wall between the first and second planar game surfaces be non-vertical, such as being steeply angled (e.g., 45-60 degrees) upward from the first planar game surface to the second planar game surface.) In the illustrated embodiment, the connection between the first planar game surface 20 and the vertical wall 28 and the connection between the vertical wall 28 and the second planar game surface 24 are curved for aesthetics. To increase the complexity of the game, one or more openings (not illustrated) large enough for the bean bag 40 to pass through may be defined in the wall between the first and second planar game surfaces.

The angle of the first planar game surface 20 to the foot 12 (and therefore to the surface upon which the target device sits) and the angle of the second planar game surface 24 to the foot 12 (and therefore to the surface upon which the target device sits) may be substantially equal, as illustrated, or may vary. Even if the angles are intended to be substantially equal, minor variances (e.g., less than about 10 degrees) are typically acceptable.

Trying to throw the bean bag 40 into the first target hole 22 is similar in technique and complexity to playing with a conventional corn hole board. Trying to throw the bean bag 40 into the second target hole 26 is significantly more challenging for at least two reasons: (1) the second planar game surface 24 is much smaller than the first planar game surface 20, such that the bean bag 40 is much more likely to fall off or completely miss the second planar game surface 24, and (2) the vertical wall 28 prevents the bean bag from sliding up the first planar game surface 20 and onto the second planar game surface 24. (Having the wall between the first and second planar game surfaces be steeply angled (rather than vertical) would potentially allow the bean bag to slide up the first planar game surface and onto the second planar game surface, but such a steep angle adds its own difficulty.) Because it is likely more difficult to get the bean bag into the second target hole as compared to the first target hole, scoring rules may be devised in which a higher point value is awarded when the bean bag goes into the second target hole as compared to the first target hole.

The target device 10 also comprises a substantially vertical planar backboard 18 at the distal end of the target device 10. (It is not necessary that the backboard 18 be perfectly vertical, and minor variances (e.g., less than about 10 degrees from vertical) are typically acceptable.) In the illustrated embodiment, the backboard 18 projects upward from the distal end 16. A basketball-type hoop 34 may be mounted to the backboard 18, as illustrated. The hoop 34 may be any suitable size and style, although it will typically be much smaller than a standard basketball hoop. The hoop 34 may be mounted using any suitable attachment mechanism, such as screws, bolts, or a quick-connect mechanism that enables the hoop to be readily attached and removed. A net 36 may be attached to the hoop 34. The net may be a closed-end net, as illustrated, or a conventional basketball-type open-end net. Alternatively, the backboard 18 may define a third target hole 38 (shown in dashed lines as optional).

As illustrated by the dashed line arrows in FIG. 1, game play may involve tossing the bean bag 40 to attempt to get the bean bag through the first target hole 22, the second target hole 26, the third target hole 38 (if present), or the hoop 34 (if present). Scoring rules may be devised in which different point values are awarded for each different target.

The target device 10 further comprises a substantially horizontal shelf 30 affixed to or integral with and projecting outward from the proximal side of the backboard 18. (It is not necessary that the shelf 30 be perfectly horizontal, and minor variances (e.g., less than about 10 degrees from horizontal) are typically acceptable.) A substantially vertical connection wall 32 connects the shelf 30 to the distal end of the second planar game surface 24. (It is not necessary that the connection wall 32 be perfectly vertical, and minor variances (e.g., less than about 10 degrees from vertical) are typically acceptable.) In the illustrated embodiment, the connection between the connection wall 32 and the second planar game surface 24 are curved for aesthetics. The shelf 30 is supported by the frame at a third height above the surface, which is typically less than the height of the second planar game surface 24. Bean bags that go past the second planar game surface 24 (intentionally or unintentionally) and hit the backboard 18 or go through the hoop 34 then land on the shelf 30. Thus, the shelf 30 functions as a bean bag collection area, enabling convenient and easy collection of thrown bean bags.

The target device of embodiments of the invention may be constructed of any suitable material or combination of materials, such as any suitable metal, any suitable plastic, or wood. The backboard 18, distal end 16, foot 12, proximal end 14, first planar game surface 20, vertical wall 28, second planar game surface 24, connection wall 32, and shelf 30 may be all together formed from an elongated single unitary sheet of material. The single unitary sheet of material (typically metal or plastic) may be bent or otherwise formed into the desired shape. Once bent or otherwise formed into the desired shape, the distal end of the shelf would typically be affixed to the backboard, using any suitable connection method such as welding.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below (if any) are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A bean bag toss game target device having a proximal end and a distal end, the target device comprising:

a support frame adapted to sit on a surface;

a first planar game surface adapted to be supported by the support frame at a first angle to the surface and at a first height above the surface, the first planar game surface defining a first target hole;

a second planar game surface adapted to be supported by the support frame at a second angle to the surface and at a second height above the surface, the second planar game surface defining a second target hole;

a substantially vertical planar backboard at the distal end of the target device, the backboard having a proximal side toward the proximal end of the target device and an opposing distal side; and a substantially horizontal shelf adapted to be supported by the support frame at a third height above the surface, the shelf being affixed to or integral with and projecting outward from the proximal side of the backboard;

wherein the first planar game surface is closer to the proximal end of the target device than is the second planar game surface;

wherein the second planar game surface is closer to the distal end of the target device than is the first planar game surface;

wherein the proximal end of the target device is curved with a curvature of the curve being related to the first height;

wherein the first height above the surface is less than the second height above the surface;

wherein the third height is less than the second height;

wherein a distal end of the first planar game surface is connected to a proximal end of the second planar game surface;

wherein the distal end of the first planar game surface is connected to the proximal end of the second planar game surface via a substantially vertical wall; and wherein the support frame, the first planar game surface, the substantially vertical wall, the second planar game surface, the backboard, and the shelf are all together a single unitary sheet of material.

2. The target device of claim 1, wherein the first angle and the second angle are substantially equal.

3. The target device of claim 1, wherein the first target hole is a sole hole defined by the first planar game surface.

4. The target device of claim 1, further comprising a target hoop affixed to the backboard and projecting outward from the proximal side of the backboard.

5. The target device of claim 4, further comprising a net affixed to and hanging down from the target hoop.

6. The target device of claim 1, wherein the backboard defines a third target hole.

7. The target device of claim 1, wherein the second target hole is a sole hole defined by the second planar game surface.

8. The target device of claim 1, wherein the single unitary sheet of material is metal.

9. A target device comprising:

a support frame further comprising:

a foot adapted to sit on a surface;

a proximal end; and a distal end;

a first planar game surface supported by the support frame at a first angle to the surface and at a first height above the surface, the first planar game surface including only one first target hole;

a second planar game surface supported by the support frame at a second angle to the surface and at a second height above the surface, the second planar game surface including only one second target hole;

a planar backboard at the distal end of the support frame, the planar backboard having a proximal side toward the proximal end of the support frame and an opposing distal side; and a substantially horizontal shelf supported by the support frame at a third height above the surface, the shelf being affixed to or integral with and projecting outward from the proximal side of the backboard;

wherein the first planar game surface is closer to the proximal end of the support frame than is the second planar game surface;

wherein the second planar game surface is closer to the distal end of the support frame than is the first planar game surface;

wherein the proximal end of the support frame and the distal end of the support frame are curved; and wherein a distal end of the first planar game surface is connected to a proximal end of the second planar game surface via a wall.

10. The target device of claim 9, wherein the wall is substantially vertical.

11. The target device of claim 9, wherein the wall is at an angle between 45 degrees and 60 degrees from the first planar game surface.

12. The target device of claim 9, wherein the support frame, the first planar game surface, the wall, the second planar game surface, the backboard, and the shelf are all together a single unitary sheet of material.

13. The target device of claim 12, wherein the single unitary sheet of material is metal.

14. The target device of claim 13, further comprising a net affixed to and hanging down from the target hoop.

15. The target device of claim 9, further comprising a target hoop affixed to the planar backboard and projecting outward from the proximal side of the planar backboard.

16. The target device of claim 9, wherein the planar backboard includes only one third target hole.

17. The target device of claim 9, wherein a surface area of the second planar surface is less than a surface area of the first planar surface.

18. The target device of claim 9, wherein the first angle and the second angle are substantially equal.

19. The target device of claim 9, wherein a curvature of the curved proximal end of the support frame is related to the first height.

* * * * *